US010077778B2

(12) United States Patent
Yamashita

(10) Patent No.: US 10,077,778 B2
(45) Date of Patent: Sep. 18, 2018

(54) MULTISTAGE CENTRIFUGAL COMPRESSOR

(71) Applicant: MITSUBISHI HEAVY INDUSTRIES COMPRESSOR CORPORATION, Tokyo (JP)

(72) Inventor: Shuichi Yamashita, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 141 days.

(21) Appl. No.: 14/916,282

(22) PCT Filed: Sep. 12, 2014

(86) PCT No.: PCT/JP2014/074262
§ 371 (c)(1),
(2) Date: Mar. 3, 2016

(87) PCT Pub. No.: WO2015/041174
PCT Pub. Date: Mar. 26, 2015

(65) Prior Publication Data

US 2016/0201687 A1 Jul. 14, 2016

(30) Foreign Application Priority Data

Sep. 18, 2013 (JP) ..... 2013-193390

(51) Int. Cl.
*F04D 17/12* (2006.01)
*F04D 29/053* (2006.01)
(Continued)

(52) U.S. Cl.
CPC ..... *F04D 17/122* (2013.01); *F04D 29/053* (2013.01); *F04D 29/286* (2013.01);
(Continued)

(58) Field of Classification Search
CPC .. F04D 17/122; F04D 29/053; F04D 29/4226; F04D 29/286; F04D 29/444; F04D 29/441; F05D 2250/52
See application file for complete search history.

(56) References Cited

U.S. PATENT DOCUMENTS 4,938,661 A * 7/1990 Kobayashi ..... F04D 29/444 415/199.1
8,267,644 B2 * 9/2012 Nishida ..... F04D 17/122 415/198.1
2010/0028141 A1 * 2/2010 Nishida ..... F04D 17/122 415/198.1

FOREIGN PATENT DOCUMENTS

CN 1214106 A 4/1999
JP 56-72300 A 6/1981
(Continued)

OTHER PUBLICATIONS

Chinese Office Action, dated Jan. 5, 2017, for Chinese Application No. 201480049244.7, along with an English translation.
(Continued)

*Primary Examiner* — Eldon Brockman
(74) *Attorney, Agent, or Firm* — Birch, Stewart, Kolasch & Birch, LLP

(57) ABSTRACT

A multistage centrifugal compressor includes a rotating shaft; a first impeller and a second impeller fixed to the rotating shaft; and a casing configured to surround the rotating shaft and the first and second impellers, that forms a first diffuser channel allowing the flowing through of a fluid which is discharged from the first impeller, that forms a first return channel, that forms a second diffuser channel allowing the flowing through of the fluid which is discharged from the second impeller, that forms a second return channel, wherein the first impeller is disposed adjacent to the second impeller in the axial direction of the rotating shaft, in
(Continued)

the first diffuser channel, a vaneless diffuser is disposed, and in the second diffuser channel, a vaned diffuser having multiple vanes is disposed.

1 Claim, 4 Drawing Sheets

(51) Int. Cl.
*F04D 29/28* (2006.01)
*F04D 29/42* (2006.01)
*F04D 29/44* (2006.01)

(52) U.S. Cl.
CPC ..... *F04D 29/4226* (2013.01); *F04D 29/441* (2013.01); *F04D 29/444* (2013.01); *F05D 2250/52* (2013.01)

(56) References Cited

FOREIGN PATENT DOCUMENTS

| | | | |
|---|---|---|---|
| JP | 11-303797 | A | 11/1999 |
| JP | 2010-31777 | A | 2/2010 |
| JP | 2011-122516 | A | 6/2011 |
| JP | 5104624 | B2 | 12/2012 |

OTHER PUBLICATIONS

International Search Report (form PCT/ISA/210), dated Dec. 2, 2014, for International Application No. PCT/JP2014/074262, along with an English translation.
Written Opinion of the International Searching Authority (form PCT/ISA/237), dated Dec. 2, 2014, for International Application No. PCT/JP2014/074262, along with an English translation.

* cited by examiner

MULTISTAGE CENTRIFUGAL COMPRESSOR

TECHNICAL FIELD

The present invention relates to a rotating machine including a rotating shaft, and multiple impellers which are fixed to the rotating shaft and rotate together with the rotating shaft.

Priorities of this application are claimed based on Japanese Patent Application No. 2013-193390 filed on Sep. 18, 2013, the content of which is incorporated herein by reference.

BACKGROUND ART

As well known, a rotating machine such as a centrifugal compressor is configured to allow gas to pass through a rotating impeller in a radial direction of the rotating impeller, and to compress the gas by centrifugal force occurring during rotation. A multistage centrifugal compressor including impellers of multiple stages in an axial direction, and compressing gas in stages is known as this type of centrifugal compressor.

The impellers are rotatably supported by a rotating shaft in a casing of the centrifugal compressor. The centrifugal compressor suctions a fluid such as air or gas via a suction port of the casing, and applies centrifugal force to the fluid by rotating the impellers via the rotating shaft. Kinetic energy induced by the centrifugal force is converted into compression energy by diffusers and a scroll portion, and the compressed gas is sent from a discharge port of the casing.

Among the aforementioned rotating machines, particularly, a centrifugal compressor, in which many impellers are installed on the same shaft, and each of the impellers has one outlet for gas, is referred to as a straight type centrifugal compressor among single-shaft multistage centrifugal compressors.

PTL 1 discloses an example of a single-shaft multistage centrifugal compressor in which a stage having a vaneless diffuser and a stage having a vaned diffuser are combined together. This centrifugal compressor aims to maintain high efficiency in the stage having the vaned diffuser, and to secure a wide operating range in the stage having the vaneless diffuser.

CITATION LIST

Patent Literature

[PTL 1] Japanese Unexamined Patent Application Publication No. 2010-31777

SUMMARY OF INVENTION

Technical Problem

In a rotating machine including impellers of multiple stages, the temperature of gas is further increased as the gas passes through a further downstream stage. In contrast, when the impellers of all of the stages have the same diameter, the impellers of all of the stages rotate at the same rotational speed, and the speed of sound is further increased due to an increase in the temperature as the gas passes through a further downstream stage. Accordingly, an upstream stage has a high machine Mach number (a value obtained by dividing the circumferential speed of the impeller by the speed of sound), and a downstream stage has a low machine Mach number.

As with the rotating machine disclosed in PTL 1, when a vaned diffuser is provided in an upstream stage having a high machine Mach number, an operating range (flow rate range) may be narrowed compared to when a vaneless diffuser is provided.

Since gas is compressed and a volumetric flow rate is decreased as the gas passes through a further downstream stage, the width of a flow path of a downstream stage becomes narrower than an upstream stage. When a vaneless diffuser is provided in a downstream stage having a narrow width of a flow path, efficiency may be decreased.

That is, when the rotating machine has a configuration in which a vaned diffuser of an upstream stage and a vaneless diffuser of a downstream stage are combined together, it may not be able to not only satisfactorily maintain high efficiency but also satisfactorily secure a wide operating range.

An object of the present invention is to provide a rotating machine in which not only high efficiency is maintained but also a wide operating range is secured.

Solution to Problem

According to a first aspect of the present invention, there is provided a rotating machine including: a rotating shaft; multiple impellers fixed to the rotating shaft, and rotating together with the rotating shaft; and a casing configured to surround the rotating shaft and the impellers, and to form diffuser channels allowing the flowing through of a fluid which is discharged from the impellers to an outward side in a radial direction, and return channels by which the fluid flowing through the diffuser channels is guided to an inward side in the radial direction, and is introduced into the impellers of downstream stages. The multiple impellers are formed such that the sectional area of a flow path of the impeller for the fluid is smaller when the impeller is disposed at a further downstream stage. The diffuser channel of an upstream stage of the diffuser channels respectively corresponding to a pair of adjacent impellers is a vaneless diffuser, and the diffuser channel of a downstream stage is a vaned diffuser.

In this configuration, it is possible to secure a wide operating range by providing a vaneless diffuser in an upstream stage having a high machine Mach number, and it is possible to maintain high efficiency by providing a vaned diffuser in a downstream stage having a small sectional area of a flow path. As a result, it is possible to provide the rotating machine in which not only high efficiency is maintained but also a wide operating range is secured.

In the rotating machine, all the diffuser channels of upstream stages disposed further upstream of the diffuser channel disposed in the upstream stage may be vaneless diffusers. All the diffuser channels of downstream stages disposed further downstream of the diffuser channel disposed in the downstream stage may be vaned diffusers.

In the rotating machine, multiple pairs of the impellers may be connected to each other in an axial direction of the rotating shaft.

Advantageous Effects of Invention

According to the present invention, it is possible to secure a wide operating range by providing a vaneless diffuser in an upstream stage having a high machine Mach number, and it is possible to maintain high efficiency by providing a vaned diffuser in a downstream stage having a small sectional area of a flow path. As a result, it is possible to provide a rotating machine in which not only high efficiency is maintained but also a wide operating range is secured.

DESCRIPTION OF EMBODIMENTS

First Embodiment

Hereinafter, embodiments of the present invention will be described in detail with reference to the accompanying drawings. In the embodiment, a single-shaft multistage centrifugal compressor including multiple impellers is exemplarily described.

Figure 1:
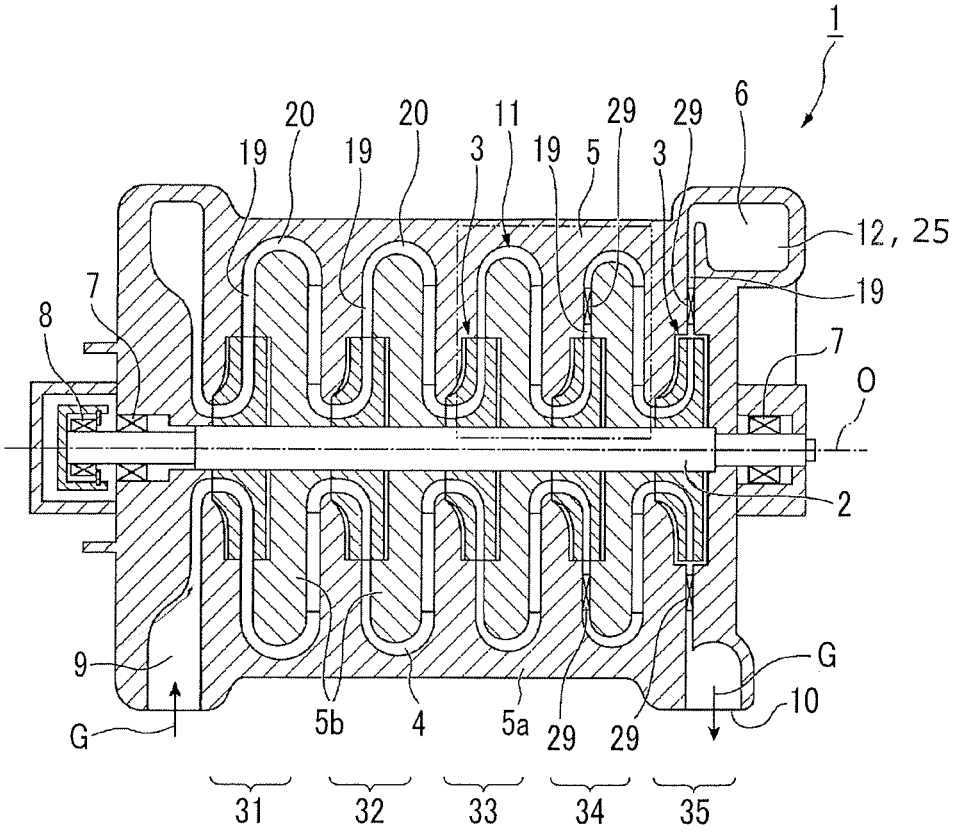
FIG. 1 is a schematic sectional view of a centrifugal compressor in a first embodiment of the present invention.

As illustrated in FIG. 1, a centrifugal compressor 1 in the embodiment is configured to include the following main components: a rotating shaft 2 rotating around an axial line O; an impeller 3 attached to the rotating shaft 2, and compressing a fluid G (for example, air) by centrifugal force; and a casing 5 which rotatably supports the rotating shaft 2, and is provided with a flow path 4 through which the fluid G flows from an upstream side to a downstream side.

The casing 5 has a substantially tubular outline. The rotating shaft 2 is disposed to penetrate through the center of the casing 5. Journal bearings 7 are respectively provided at both ends of the casing 5 in an axial direction of the rotating shaft 2. A thrust bearing 8 is provided at one of both ends. The journal bearings 7 and the thrust bearing 8 rotatably support the rotating shaft 2. That is, the rotating shaft 2 is supported by the casing 5 via the journal bearings 7 and the thrust bearing 8.

A suction port 9 is provided on a first side of the casing 5 in the axial direction, and the fluid G flows into the casing 5 from the outside via the suction port 9. A discharge port 10 is provided on a side opposite to the first side, and the fluid G flows to the outside via the discharge port 10. An inner space 11 communicating with the suction port 9 and the discharge port 10 is provided in the casing 5, and increases and decreases in the diameter of the inner space 11 are repeated.

The inner space 11 serves as not only a space accommodating the impellers 3 but also the flow path 4. That is, the suction port 9 communicates with the discharge port 10 via the impellers 3 and the flow path 4. The casing 5 is configured to include a shroud casing 5*a* and a hub casing 5*b*. The inner space 11 is formed by the shroud casing 5*a* and the hub casing 5*b*.

Multiple impellers 3 are arranged along the axial direction of the rotating shaft 2 while being spaced apart from each other. The centrifugal compressor 1 in the embodiment has five compressor stages of a first compressor stage 31 to a fifth compressor stage 35. In the illustrated example, five impellers 3 are provided; however, at least two impellers 3 may be provided.

Figure 2:
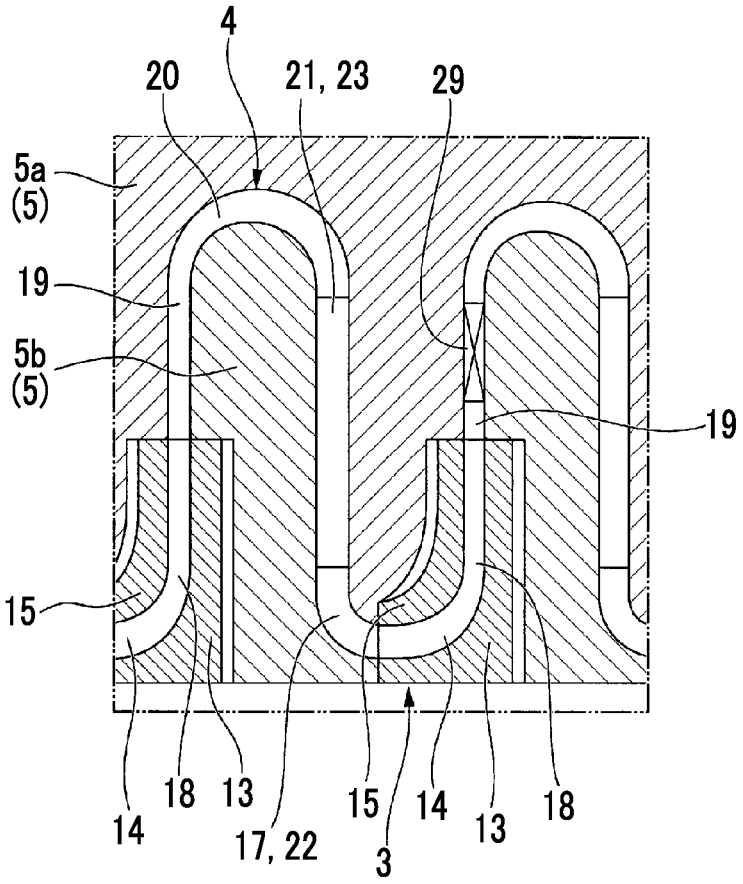
FIG. 2 is an enlarged view of impellers of the centrifugal compressor in the first embodiment of the present invention.

As illustrated in FIG. 2, each of the impellers 3 is configured to include a hub 13; a blade 14; and a shroud 15. The hub 13 is formed to have a substantially disc shape such that the diameter of the hub 13 gradually increases toward the discharge port 10. The blades 14 are radially attached to the hub 13, and multiple blades 14 are disposed side by side in a circumferential direction. The shroud 15 is attached in such a way as to cover tip sides of the multiple blades 14 in the circumferential direction.

While meandering in a radial direction of the rotating shaft 2, the flow path 4 progresses in the axial direction to connect the impellers 3 such that the fluid G is compressed in stages by the multiple impellers 3. The flow path 4 is configured to include a suction channel 17; a compression channel 18; a diffuser channel 19; and a return channel 20 as main components. The diffuser channel 19 is a channel which converts kinetic energy applied to the fluid G by the impeller 3 into pressure energy.

The impeller 3 is formed such that the sectional area of a flow path of the impeller 3 for the fluid G is smaller when the impeller 3 is disposed at a further downstream stage. In other words, the compression channel 18 is formed to become narrower as the fluid G approaches the downstream side.

The suction channel 17 is a channel which allows the fluid G to flow inward from an outward side of the channel in the radial direction, and then changes the direction of the fluid G to the axial direction of the rotating shaft 2 when the fluid G reaches a region immediately before the impeller 3. Specifically, the suction channel 17 is configured as a straight channel 21 and a corner channel 22. The straight channel 21 is a straight channel which allows the fluid G to flow inward from the outward side of the channel in the radial direction. The corner channel 22 is a curved channel which changes the flow direction of the fluid G (flowing from the straight channel 21) at a radial inward side of the channel to the axial direction, and allows the fluid G to flow toward the impeller 3.

Multiple return blades 23 are radially disposed around the axial line O in the straight channel 21 positioned between two impellers 3 such that the multiple return blades 23 divide the straight channel 21 in a circumferential direction of the rotating shaft 2.

The compression channel 18 is a channel which compresses the fluid G (sent from the suction channel 17) in the impeller 3. The compression channel 18 is surrounded by a blade installation surface of the hub 13, and an inner wall surface of the shroud 15.

A radial inward side of the diffuser channel 19 communicates with the compression channel 18. The diffuser channel 19 serves as a channel which allows the fluid G compressed by the impeller 3 to flow to a radial outward side of the channel. The radial outward side of the diffuser channel 19 communicates with the return channel 20. The diffuser channel 19, which is connected to a radial outward side of the impeller 3 (a fifth stage impeller 3 in FIG. 1) positioned on the furthest downstream side of the flow path 4, communicates with a discharge scroll 12 (to be described later).

The return channel 20 is formed to have a substantially U-shaped section. The diffuser channel 19 communicates with an upstream end of the return channel 20, and the straight channel 21 of the suction channel 17 communicates with a downstream end of the return channel 20. The return channel 20 reverses the flow direction of the fluid G (flowing to an outward side in the radial direction via the diffuser channel 19 by the impeller 3 (the impeller 3 of an upstream stage)) to the inward side in the radial direction, and then sends the fluid G to the straight channel 21.

As described above, the impeller 3 is formed such that the sectional area of a flow path of the impeller 3 for the fluid G is smaller when the impeller 3 is disposed at a further downstream stage. Accordingly, the width of the flow path 4 is to become narrower as the fluid G approaches the downstream side (downstream stage). For example, the diffuser channel 19 is formed to become narrower when the diffuser channel 19 is positioned closer to the downstream side.

The discharge scroll 12 is provided in the casing 5 so as to discharge the fluid via a discharge port. The discharge scroll 12 includes a scroll flow path 25 which is formed to surround the entire circumference of an outlet of the diffuser channel 19 positioned in the outer circumference of a final stage impeller 3.

The scroll flow path 25 is formed to surround the entire circumference of the outlet of the diffuser channel positioned in the outer circumference of the final stage impeller 3. The scroll flow path 25 is formed in such a way that the sectional area of the scroll flow path 25 gradually and continuously increases along a rotation direction of the impeller 3.

The diffuser channel 19 and the discharge scroll 12 serve as an outlet flow path 6 through which the fluid sent from the outlet of the impeller 3 flows, and by which the pressure of the fluid is increased as the fluid approaches the downstream side.

In the centrifugal compressor according to the embodiment, the diffuser channels 19, which are respectively connected to the outlets of the impellers of the first compressor stage 31, the second compressor stage 32, and the third compressor stage 33, are vaneless diffusers. That is, vanes (diffuser vanes or blades) are not formed in the diffuser channels through which the fluid G (discharged to the radial outward side from the impellers 3 of the first compressor stage 31 to the third compressor stage 33) flows.

The diffuser channels 19 respectively connected to the outlets of the impellers 3 of the fourth compressor stage 34 and the fifth compressor stage 35 are vaned diffusers. That is, multiple vanes 29 are formed in the diffusers through which the fluid G (discharged to the radial outward side from the impellers 3 of the fourth compressor stage 34 and the fifth compressor stage 35) flows.

Hereinafter, the compression of the fluid G by the centrifugal compressor 1 with such a configuration will be described.

When the impellers 3 rotate together with the rotating shaft 2, the fluid G flowing into the flow path 4 via the suction port 9 sequentially flows from the suction port 9 to the suction channel 17, the compression channel 18, the diffuser channel 19, and then the return channel of the impeller 3 of the first compressor stage 31. Thereafter, the fluid G sequentially flows from the suction channel 17 to the compression channel 18, . . . of the impeller 3 of the second compressor stage 32. The fluid G flowing up to the discharge scroll 12 immediately after the diffuser channel 19 positioned on the furthest downstream side of the flow path 4 flows to the outside via the discharge port 10.

The fluid G is compressed by the impellers 3 while flowing through the flow path 4 in the aforementioned sequence. That is, in the centrifugal compressor 1, the fluid G is compressed in stages by the multiple impellers 3, and thus it is possible to easily obtain a large compression ratio.

Figure 3:
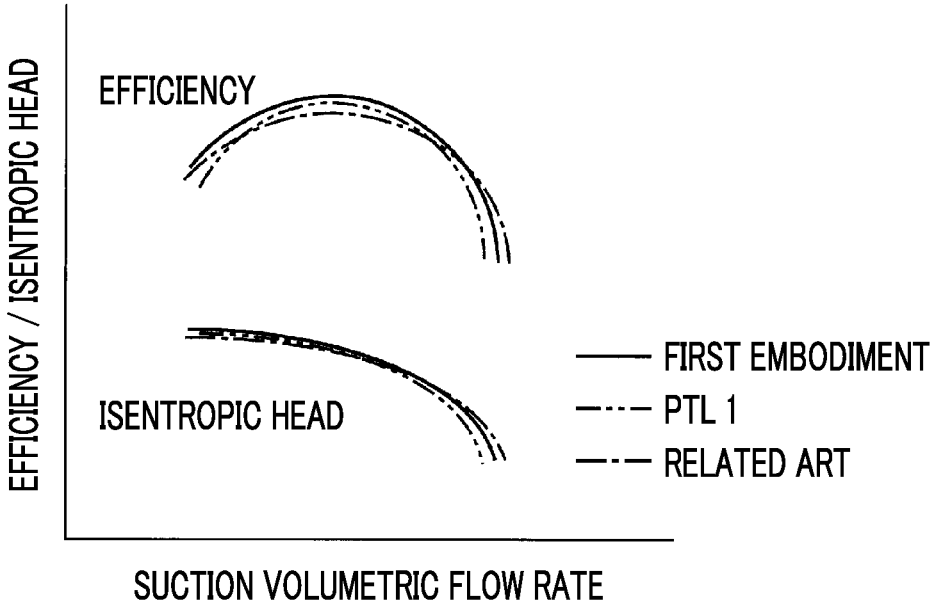
FIG. 3 is a performance curve graph for the centrifugal compressor in the first embodiment of the present invention, and a centrifugal compressor in the related art.

FIG. 3 illustrates performance test results of a centrifugal compressor in the related art, a centrifugal compressor disclosed in PTL 1, and the centrifugal compressor 1 in the embodiment.

The centrifugal compressor in the related art is configured to include vaneless diffusers in all stages. The centrifugal compressor disclosed in PTL 1 is configured to include vaned diffusers of the first compressor stage to the third compressor stage, and vaneless diffusers of the fourth compressor stage and the fifth compressor stage.

In the graph illustrated in FIG. 3, the horizontal axis represents the suction volumetric flow rate, and the vertical axis represents the isentropic head (outlet pressure of a centrifugal compressor) and the efficiency.

As illustrated in FIG. 3, both the efficiency and the operating range (flow rate range) of the centrifugal compressor are better than those of the centrifugal compressor in the related art. According to the centrifugal compressor in the embodiment, it is possible to satisfactorily obtain a wide operating range and the maintenance of high efficiency which cannot be satisfactorily obtained by the centrifugal compressor disclosed in PTL 1.

It is possible to secure a wide operating range by providing a vaneless diffuser in an upstream stage having a high machine Mach number. When the rotational speed of the impeller, the outer diameter of the impeller, and the speed of sound are assumed to be N, D, and a, respectively, a machine Mach number M is a value calculated by Expression (1).

$$M=\pi\times D\times N/60/a \tag{1}$$

When the temperature of a gas, the specific heat ratio of a gas, and a gas constant are assumed to be T, κ, and R, respectively, the speed of sound can be calculated by Expression (2).

$$a=\sqrt{(\kappa\times R\times T)} \tag{2}$$

That is, it is possible to eliminate a limitation to the operating range specified by the vanes by providing a vaneless diffuser in an upstream compressor stage having a high machine Mach number, and thus it is possible to secure a wide operating range.

It is possible to maintain high efficiency by providing a vaned diffuser in a downstream stage having a narrow width of a flow path. That is, it is possible to increase the pressure of the fluid G by the vane 29 of the diffuser channel 19.

In this configuration, it is possible to secure a wide operating range by providing a vaneless diffuser in an upstream stage having a high machine Mach number, and it is possible to maintain high efficiency by providing a vaned diffuser in a downstream stage having a small sectional area of a flow path. As a result, it is possible to provide the centrifugal compressor 1 in which not only high efficiency is maintained but also a wide operating range is secured.

Second Embodiment

Hereinafter, a centrifugal compressor 1B in a second embodiment of the present invention will be described with reference to the accompanying drawings. The points of difference of the embodiment with respect to the first embodiment will be mainly described, and the description of the same portions will be omitted.

Figure 4:
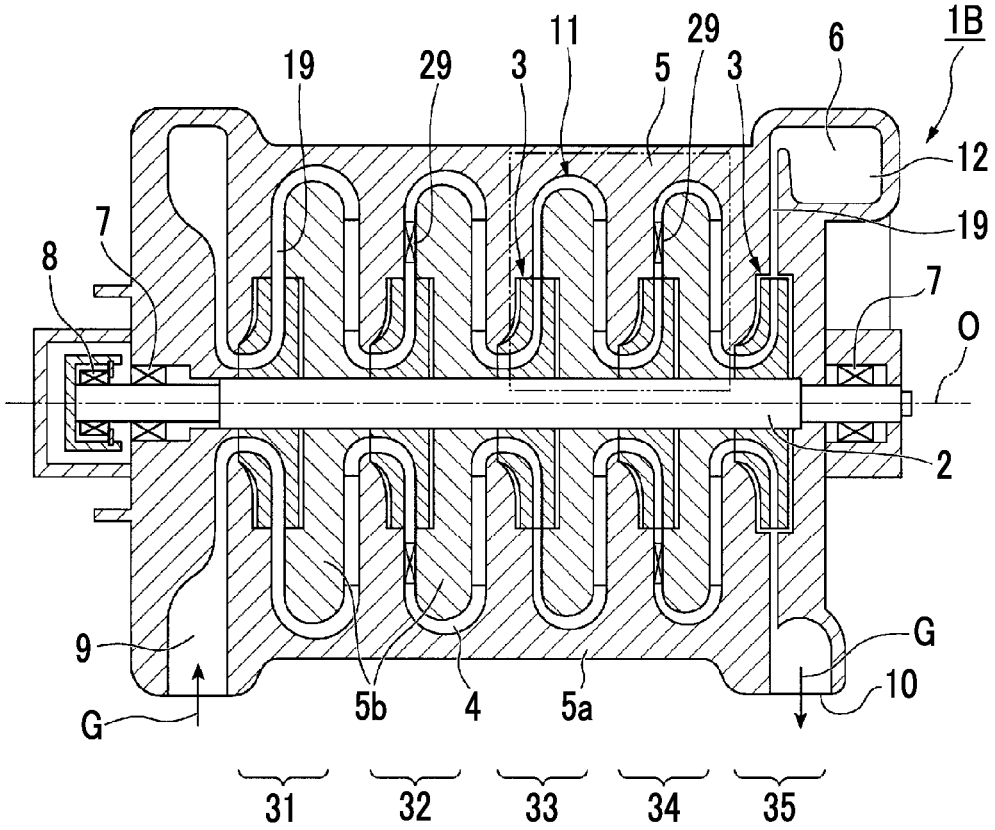
FIG. 4 is a schematic sectional view of a centrifugal compressor in a second embodiment of the present invention.

As illustrated in FIG. 4, in the centrifugal compressor 1 according to the embodiment, the diffuser channels 19 of the first compressor stage 31, the third compressor stage 33, and the fifth compressor stage 35 are vaneless diffusers. In contrast, the diffuser channels 19 of the second compressor stage 32 and the fourth compressor stage 34 are vaned diffusers.

In the embodiment, the diffuser channel 19 of an upstream stage of the diffuser channels 19 respectively corresponding to a pair of adjacent impellers 3 is a vaneless diffuser, and the diffuser channel 19 of a downstream stage is a vaned diffuser. In this configuration, it is possible to partially maintain high efficiency, and to obtain a partially high operating range.

Third Embodiment

Hereinafter, a centrifugal compressor 1C in a second embodiment of the present invention will be described with reference to the accompanying drawing.

Figure 5:
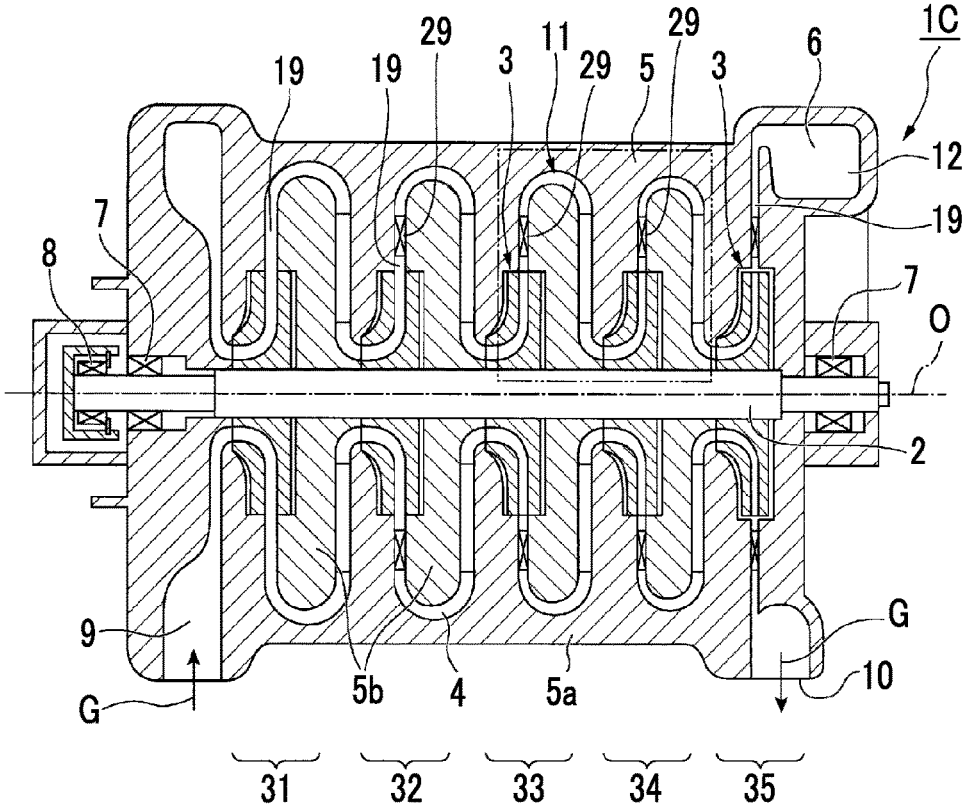
FIG. 5 is a schematic sectional view of a centrifugal compressor in a third embodiment of the present invention.

As illustrated in FIG. 5, in the centrifugal compressor 1 according to the embodiment, the diffuser channels 19 of the first compressor stage 31 is a vaneless diffuser. In contrast, the diffuser channels 19 of the second compressor stage 32, the third compressor stage 33, the fourth compressor stage 34, and the fifth compressor stage 35 are vaned diffusers. That is, the diffuser channel 19 of only the first compressor stage 31 is a vaneless diffuser, and the diffuser channels 19 of the second compressor stage 32 and the following compressor stages are vaned diffusers.

It is possible to adopt this type of disposition so as to balance the maintenance of efficiency against the securing of a wide operating range. That is, it is possible to appropriately adjust the disposition of vaneless diffusers and vaned diffusers according to required efficiency and a required operating range.

The technical scope of the present invention is not limited to the embodiments, and changes can be made to the embodiments in various forms insofar as the changes do not depart from the purport of the present invention.

For example, with regard to the diffusers of the centrifugal compressor, the disposition of the vaneless diffusers and the vaned diffusers is different in each of the embodiments, and these different dispositions can also be applied to other rotating machines, for example, multistage blowers.

INDUSTRIAL APPLICABILITY

The present invention can be applied to a rotating machine including a rotating shaft; multiple impellers fixed to the rotating shaft, and rotating together with the rotating shaft; and a casing configured to surround the rotating shaft and the impellers, and to form diffusers allowing the flowing through of a fluid which is discharged from the impellers to an outward side in a radial direction, and return channels by which the fluid flowing through the diffusers is guided to an inward side in the radial direction, and is introduced into the impellers of downstream stages.

REFERENCE SIGNS LIST

1, 1B, 1C: CENTRIFUGAL COMPRESSOR
2: ROTATING SHAFT
3: IMPELLER
4: FLOW PATH
5: CASING
6: OUTLET FLOW PATH
9: SUCTION PORT
10: DISCHARGE PORT
11: INNER SPACE
12: DISCHARGE SCROLL
13: HUB
14: BLADE
15: SHROUD
17: SUCTION CHANNEL
18: COMPRESSION CHANNEL
19: DIFFUSER CHANNEL
20: RETURN CHANNEL
21: STRAIGHT CHANNEL
22: CORNER CHANNEL
23: RETURN VANE
25: SCROLL FLOW PATH
29: VANE
31, 32, 33, 34, 35: COMPRESSOR STAGE

The invention claimed is:

1. A multistage centrifugal compressor comprising:

a rotating shaft;

a first impeller and a second impeller fixed in an axial direction of the rotating shaft, and rotating together with the rotating shaft; and a casing configured to surround the rotating shaft and the first and second impellers, that forms a first diffuser channel allowing the flowing through of a fluid which is discharged from the first impeller to an outward side in a radial direction, that forms a first return channel by which the fluid flowing through the first diffuser channel is guided to an inward side in the radial direction, and is introduced into the second impeller, that forms a second diffuser channel allowing the flowing through of the fluid which is discharged from the second impeller to the outward side in the radial direction, that forms a second return channel by which the fluid flowing through the second diffuser channel is guided to the inward side in the radial direction, wherein the first impeller is disposed adjacent to the second impeller in the axial direction of the rotating shaft, wherein in the first diffuser channel, a vaneless diffuser is disposed, wherein in the second diffuser channel, a vaned diffuser having multiple vanes is disposed, and wherein the sectional area of a flow path of the second impeller is smaller than the sectional area of a flow path of the first impeller.

* * * * *